US010665171B2

(12) United States Patent
Zhang et al.

(10) Patent No.: US 10,665,171 B2
(45) Date of Patent: May 26, 2020

(54) METHOD AND DEVICE FOR COMPENSATING FOR IMAGE CROSSTALK, AND DISPLAY APPARATUS

(71) Applicants: ORDOS YUANSHENG OPTOELECTRONICS CO., LTD., Ordos, Inner Mongolia (CN); BOE TECHNOLOGY GROUP CO., LTD., Beijing (CN)

(72) Inventors: Zhiguang Zhang, Beijing (CN); Chang Zhang, Beijing (CN); Kwanggyun Jang, Beijing (CN); Lixia Shen, Beijing (CN)

(73) Assignees: ORDOS YUANSHENG OPTOELECTRONICS CO., LTD., Ordos, Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/334,969

(22) PCT Filed: Apr. 11, 2018

(86) PCT No.: PCT/CN2018/082633
§ 371 (c)(1),
(2) Date: Mar. 20, 2019

(87) PCT Pub. No.: WO2019/001088
PCT Pub. Date: Jan. 3, 2019

(65) Prior Publication Data

US 2020/0027400 A1 Jan. 23, 2020

(30) Foreign Application Priority Data

Jun. 29, 2017 (CN) ..... 2017 1 0514891

(51) Int. Cl.
*G09G 3/3258* (2016.01)
*G09G 3/00* (2006.01)

(52) U.S. Cl.
CPC ..... *G09G 3/3258* (2013.01); *G09G 3/006* (2013.01); *G09G 2320/0209* (2013.01); *G09G 2330/12* (2013.01)

(58) Field of Classification Search
CPC ..... G09G 3/3258; G09G 3/006; G09G 2320/0209; G09G 2320/12
See application file for complete search history.

(56) References Cited

U.S. PATENT DOCUMENTS

2016/0210906 A1* 7/2016 In ..... G09G 3/3233
2016/0240128 A1 8/2016 Kim et al.
2019/0103068 A1* 4/2019 Zhang ..... G09G 3/3688

FOREIGN PATENT DOCUMENTS

CN 104064157 A 9/2014
CN 105895021 A 8/2016
(Continued)

OTHER PUBLICATIONS

International Search Report and Written Opinion for Application No. PCT/CN2018/082633, dated Jul. 13, 2018, 10 Pages.
(Continued)

*Primary Examiner* — Robert J Michaud
(74) *Attorney, Agent, or Firm* — Brooks Kushman P.C.

(57) ABSTRACT

A method and a device for compensating for image crosstalk and a display apparatus are provided. The method includes: obtaining (S101) a data-voltage variation value between a data voltage applied to a pixel unit at a current scanning time instant and a data voltage applied to the pixel unit at a previous scanning time instant; determining a power-voltage variation value based on the data-voltage variation value (S102); setting a sum of the power-voltage variation value and an original data voltage to be applied to the pixel unit at
(Continued)

a next time instant as a compensated data voltage of the pixel unit (S103); and setting the compensated data voltage of the pixel unit as an actual data voltage to be applied to the pixel unit at the next time instant (S104).

13 Claims, 3 Drawing Sheets

(56) References Cited

FOREIGN PATENT DOCUMENTS

| | | | |
|---|---|---|---|
| CN | 106782427 | A | 5/2017 |
| CN | 107068062 | A | 8/2017 |

OTHER PUBLICATIONS

International Search Report and Written Opinion, English Translation.
CN107068062A, English Abstract and Machine Translation.
CN105895021A, English Abstract and U.S. Equivalent U.S. Pub. No. 2016/0240128.
CN106782427A, English Abstract and U.S. Equivalent U.S. Pub. No. 2019/0103068.
CN104064157A, English Abstract and Machine Translation.

* cited by examiner

METHOD AND DEVICE FOR COMPENSATING FOR IMAGE CROSSTALK, AND DISPLAY APPARATUS

CROSS-REFERENCE TO RELATED APPLICATIONS

This application is the U.S. national phase of PCT Application No. PCT/CN2018/082633 filed on Apr. 11, 2018, which claims priority to Chinese Patent Application No. 201710514891.6 filed on Jun. 29, 2017, which are incorporated herein by reference in their entireties.

TECHNICAL FIELD

The present disclosure relates to the field of display technology, and in particular, relates to a method for compensating for image crosstalk, a device for compensating for image crosstalk, and a display apparatus.

BACKGROUND

Organic Light Emitting Diode (OLED) display apparatuses may be classified into a Passive Matrix OLED (PMOLED) type and an Active Matrix OLED (AMOLED) type according to driving modes of the OLED display apparatuses.

An AMOLED display component is a current-driven component and a display brightness of the AMOLED display component is related to a current intensity. A current flowing through the AMOLED component is controlled by a driving thin film transistor (DTFT), i.e., I is in proportion to $|V_{gs}-V_{th}|$, where I represents the current flowing through the AMOLED display component, $V_{gs}$ represents a voltage difference between a gate electrode and a source electrode of the DTFT, and $V_{th}$ represents a threshold voltage. Usually, a voltage Vs of the source electrode is a first power voltage $V_{ELVDD}$, and a voltage Vg of the gate electrode is a data voltage $V_{data}$, so the brightness of the AMOLED display component is related to $|V_{ELVDD}-V_{data}|^2$.

SUMMARY

The present disclosure provides a method for compensating for image crosstalk, a device for compensating for image crosstalk and a display apparatus.

In a first aspect, a method for compensating for image crosstalk is provided in the present disclosure and includes obtaining a data-voltage variation value between a data voltage applied to a pixel unit at a current scanning time instant and a data voltage applied to the pixel unit at a previous scanning time instant; determining a power-voltage variation value based on the data-voltage variation value; setting a sum of the power-voltage variation value and an original data voltage to be applied to the pixel unit at a next time instant as a compensated data voltage of the pixel unit; and setting the compensated data voltage of the pixel unit as an actual data voltage to be applied to the pixel unit at the next time instant.

Optionally, the determining the power-voltage variation value based on the data-voltage variation value includes: obtaining a coupling parameter of the pixel unit; and setting a product of the data-voltage variation value of the pixel unit and the coupling parameter of the pixel unit as the power-voltage variation value.

Optionally, the obtaining the coupling parameter of the pixel unit includes: obtaining the coupling parameter by testing a jump of the data voltage applied to the pixel unit.

Optionally, the determining the power-voltage variation value based on the data-voltage variation value includes: obtaining a coupling parameter of the pixel unit; obtaining data-voltage variation values between the current scanning time instant and the previous scanning time instant, coupling parameters and weight values of N adjacent pixel units adjacent to the pixel unit respectively, where N is a natural number; calculating a product of the data-voltage variation value, the coupling parameter and the weight value of each adjacent pixel unit of the N adjacent pixel units so as to obtain a reference data-voltage variation value of the each adjacent pixel unit of the N adjacent pixel units; and setting, as the power-voltage variation value, a sum of the reference data-voltage variation values of the N adjacent pixel units and a product of the coupling parameter and the data-voltage variation value of the pixel unit.

Optionally, obtaining the compensated data voltage of the pixel unit based on the power-voltage variation value and the original data voltage to be applied to the pixel unit at the next time instant includes: setting the sum of the power-voltage variation value and the original data voltage to be applied to the pixel unit at the next time instant as the compensated data voltage of the pixel unit.

Optionally, the adjacent pixel units and the pixel unit are arranged in a same pixel row, and the adjacent pixel units are adjacent to the pixel unit.

In a second aspect, a device for compensating for image crosstalk is provided in the present disclosure and includes: a first obtaining module, configured to obtain a data-voltage variation value between a data voltage applied to a pixel unit at a current scanning time instant and a data voltage applied to the pixel unit at a previous scanning time instant; a determination module, configured to determine a power-voltage variation value of the pixel unit based on the data-voltage variation value; a second obtaining module, configured to set a sum of the power-voltage variation value and an original data voltage to be applied to the pixel unit at a next time instant as a compensated data voltage of the pixel unit; and a voltage compensation module, configured to set the compensated data voltage of the pixel unit as an actual data voltage to be applied to the pixel unit at a next time instant.

Optionally, the determination module includes: a first parameter obtaining sub-module, configured to obtain a coupling parameter of the pixel unit; and a first determination sub-module, configured to set a product of the data-voltage variation value of the pixel unit and the coupling parameter of the pixel unit as the power-voltage variation value.

Optionally, the first parameter obtaining sub-module is further configured to obtain the coupling parameter by testing a jump of the data voltage applied to the pixel unit.

Optionally, the determination module includes: a second parameter obtaining sub-module, configured to obtain a coupling parameter of the pixel unit; a third parameter obtaining sub-module, configured to obtain data-voltage variation values between the current scanning time instant and the previous scanning time instant, coupling parameters and weight values of N adjacent pixel units adjacent to the pixel unit respectively, where N is a natural number; a calculation sub-module, configured to calculate a product of the data-voltage variation value, the coupling parameter and the weight value of each adjacent pixel unit of the N adjacent pixel units so as to obtain a reference data-voltage variation value of the each adjacent pixel unit of the N adjacent pixel units; and a second determination sub-module, configured to set, as the power-voltage variation value, a sum of a product of the coupling parameter and the data-voltage variation value of the pixel unit and the reference data-voltage variation values of the N adjacent pixel units.

Optionally, the second obtaining module is further configured to set a sum of the power-voltage variation value and the original data voltage as the compensated data voltage.

Optionally, the adjacent pixel units and the pixel unit are arranged in a same pixel row, and the adjacent pixel units are adjacent to the pixel unit.

In a third aspect, a display apparatus is provided in the present disclosure, and the display apparatus includes the device for compensating for image crosstalk according to the second aspect.

DETAILED DESCRIPTION

Detail description is given in conjunction with drawings and specific embodiments of the present disclosure. The embodiments are used to explain to present disclosure, rather than to limit the scope of the present disclosure.

Figure 1:
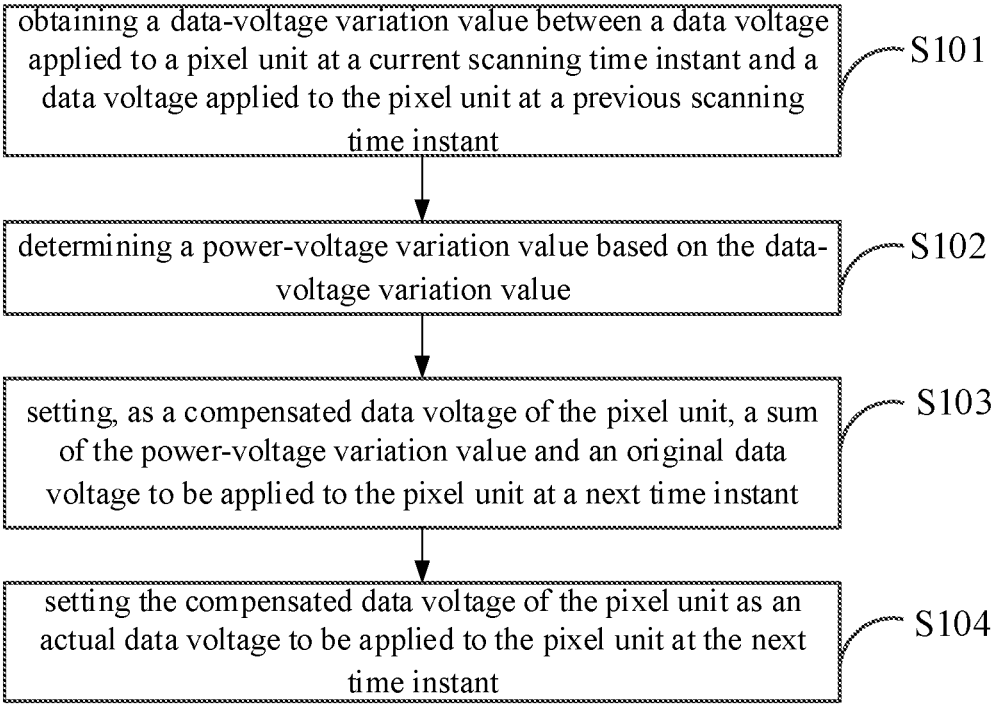
FIG. 1 illustrates a flow chart of a method for compensating for image crosstalk according to some embodiments of the present disclosure.

FIG. 1 illustrates a flow chart of a method for compensating for image crosstalk according to some embodiments of the present disclosure. As shown in FIG. 1, the method for compensating for image crosstalk includes steps S101 to S104.

Step 101: obtaining a data-voltage variation value between a data voltage applied to a pixel unit at a current scanning time instant and a data voltage applied to the pixel unit at a previous scanning time instant.

In step 101, the data voltage applied to the pixel unit at the current scanning time instant and the data voltage applied to the pixel unit at the previous scanning time instant are obtained, and a difference between the data voltage applied to the pixel unit at the current scanning time instant and the data voltage applied to the pixel unit at the previous scanning time instant is obtained as the data-voltage variation value of the pixel unit.

Specifically, the data-voltage variation value of the pixel unit may be represented by $\Delta V_{data}$, and a following formula: $\Delta V_{data}=V_{data}(t1)-V_{data}(t0)$ may be acquired, wherein, t0 represents the previous scanning time instant, t1 represents the current scanning time instant, $V_{data}(t0)$ represents the data voltage applied to the pixel unit at the previous scanning time instant, and $V_{data}(t1)$ represents the data voltage applied to the pixel unit at the current scanning time instant.

Step 102: determining a power-voltage variation value based on the data-voltage variation value.

In step 102, a coupling parameter $X_{Gain}$ corresponding to the pixel unit is obtained, the data-voltage variation value of the pixel unit is multiplied by the coupling parameter corresponding to the pixel unit, and a result of the multiplication (a product) is taken as the power-voltage variation value. In the present disclosure, a function of the coupling parameter $X_{Gain}$ may be obtained by testing a signal coupling characteristic of an AMOLED display device.

In practical applications, the coupling parameter $X_{Gain}$ corresponding to the pixel unit may also be obtained by testing a jump of a data voltage applied to the pixel unit. The testing the jump of the data voltage applied to the pixel unit may include: controlling driving signals applied to two columns of pixel units, respectively; maintaining a voltage V of a first column of the two columns of pixel units at L0 (i.e., V=L0); performing switching operations on a voltage V of a second column of the two columns of pixel units from L0 to L1 (i.e. the voltage V is jumped from L0 (V=L0) to L1 (V=L1)), from L0 to L2 (i.e. the voltage V is jumped from L0 (V=L0) to L2 (V=L2)), from L0 to L255 (i.e. the voltage V is jumped from L0 (V=L0) to L255 (V=L255)); and measuring and recording values of coupling voltages coupled on the first column of pixel units when voltage jumps of the second column of pixel units are L1 (V=L1) to L255 (V=L255), respectively. In this way, the function of the coupling parameter $X_{Gain}$ may be simulated through a point-by-point approach.

The coupling parameter may also be related to a data-voltage variation value of a pixel unit adjacent to the pixel unit.

Optionally, for sake of further alleviating a crosstalk phenomenon resulted from cross wirings, in step 102, data-voltage variation values between the current scanning time instant and the previous scanning time instant, coupling parameters, and weight values of N adjacent pixel units adjacent to the pixel unit may be obtained respectively, wherein N is a natural number. A product of the data-voltage variation value, the coupling parameter and the weight value of each of the N adjacent pixel units is calculated to obtain a reference data-voltage variation value of the each of the N adjacent pixel units. A sum of the reference data-voltage variation values of the N adjacent pixel units and a product of the coupling parameter and the data-voltage variation value of the pixel unit is taken as the power-voltage variation value of the pixel unit.

The adjacent pixels units refer to pixel units that are arranged in a same pixel row as a pixel row of the pixel unit and adjacent to the pixel unit. For a certain pixel unit, usually, 3 to 5 pixel units that are located adjacent to the pixel unit and arranged in the same pixel row as the pixel row of the pixel unit are taken as the adjacent pixel units.

Figure 2:
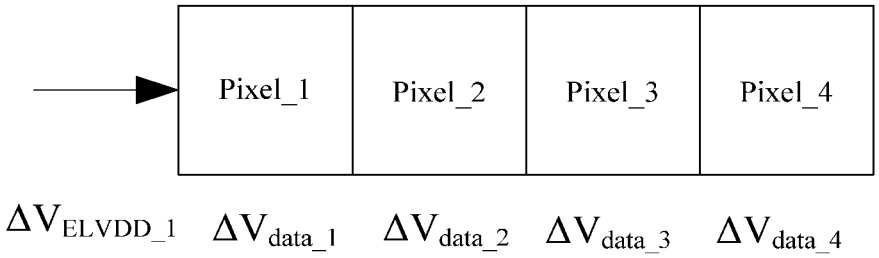
FIG. 2 is a schematic diagram of adjacent pixel units according to some embodiments of the present disclosure.

Specifically, as shown in FIG. 2, adjacent pixel units of a pixel unit 1 (Pixel_1) are a pixel unit 2 (Pixel_2), a pixel unit 3 (Pixel_3) and a pixel unit 4 (Pixel_4) arranged in a pixel row same as the pixel row of the pixel unit 1. Although the adjacent pixel units Pixel_2 to Pixel_4 adjacent to the pixel unit Pixel_1 are illustrated to a right side of the pixel unit in FIG. 2, adjacent pixel units adjacent to a pixel unit may be located to a left side of the pixel unit or may be located to both the right side and the left side of the pixel unit. Hence, a position relationship among the pixel unit and the adjacent pixel units adjacent to the pixel unit shown in FIG. 2 is merely illustrative and should not limit the scope of the present disclosure.

In the pixel units shown in FIG. 2, a power-voltage ($V_{ELVDD}$) variation value of pixel unit 1 may be calculated using a formula (1) as follow:

$$\Delta V_{ELVDD}_1 = X_{Gain}_1 \times \Delta V_{data}_1 + \alpha 1 \times X_{Gain}_2 \times \Delta V_{data}_2 + \alpha 2 \times X_{Gain}_3 \times \Delta V_{data}_3 + \alpha 3 \times X_{Gain}_4 \times \Delta V_{data}_4 \quad \text{formula (1)}$$

where, $\Delta V_{ELVDD}_1$ represents the power-voltage ($V_{ELVDD}$) variation value of the pixel unit 1, $\Delta V_{data}_1$ represents the data-voltage ($V_{data}$) variation value of the pixel unit 1, $X_{Gain}_1$ represents the coupling parameter of the pixel unit 1, $\Delta V_{data}_2 \sim \Delta V_{data}_4$ represent the data-voltage ($V_{data}$) variation values of the pixel units 2 to 4, $X_{Gain}_2 \sim X_{Gain}_4$ represent the coupling parameters of the pixel units 2 to 4, and a1~a3 represent the weight values of the pixel units 2 to 4. Generally, the closer the pixel unit and an adjacent pixel unit are, the greater a coupling influence of a data voltage variation of the adjacent pixel unit to the $V_{ELVDD}$ is. Hence, an adjacent pixel unit closer to the pixel unit may be set with a larger weight value. In this way, in the example shown in FIG. 2, values of a1 to a3 may be set to decrease gradually.

Step 103: setting, as a compensated data voltage of the pixel unit, a sum of the power-voltage variation value and an original data voltage to be applied to the pixel unit at a next time instant.

The original data voltage refers to a data voltage that is preset to be applied to the pixel unit. In step 103, the sum of the original data voltage and the power-voltage variation value is taken as the compensated data voltage. That is to say, $V_{data}' = V_{data} + \Delta V_{ELVDD}$, where $V_{data}'$ represents the compensated data voltage, $V_{data}$ represents the original data voltage and $\Delta_{ELVDD}$ represents the power-voltage variation value.

Step 104: setting the compensated data voltage of the pixel unit as an actual data voltage to be applied to the pixel unit at the next time instant.

Practically, as described above, the display brightness of the AMOLED display component is related to the $|V_{ELVDD} - V_{data}|^2$. In the embodiments of the present disclosure, the image crosstalk phenomenon resulted from signal couplings is alleviated by compensating the data voltage applied to the pixel unit.

For a certain pixel unit, a difference between a data voltage $V_{data}$ applied to the pixel unit at a current scanning time instant and a data voltage $V_{data}$ applied to the pixel unit at a previous scanning time instant is $\Delta V_{data}$, where $\Delta V_{data} = V_{data}(t1) - V_{data}(t0)$; and the power-voltage ($V_{ELVDD}$) variation value may be determined based on an obtained image coupling parameter of the pixel unit: $\Delta V_{ELVDD} = X_{Gain} \times \Delta V_{data}$, where $\Delta V_{ELVDD} = V_{ELVDD}' - V_{ELVDD} = X_{Gain} \times \Delta V_{data}$ and $V_{ELVDD}' = V_{ELVDD} + \Delta V_{ELVDD}$. Here, $V_{ELVDD}'$ represents a power voltage when the image coupling phenomenon takes place and $V_{ELVDD}$ represents an actual power voltage. Based on the relationship between the display brightness and the $|V_{ELVDD} - V_{data}|^2$ and a fact that the data voltage variation is a curve having a single change direction (a curve having a non-parabolic shape), it may be determined that $|V_{ELVDD}' - V_{data}'| = |V_{ELVDD} + \Delta V_{ELVDD} - V_{data}'|$, then it can be determined that $V_{data}' = V_{data} + \Delta V_{ELVDD}$. At the next scanning time instant, the compensated data voltage is used as the actual data voltage applied to the pixel unit, in order to alleviate the crosstalk phenomenon.

In practical, a compensation algorithm in the foregoing embodiments may be stored in a driving chip, and an AMOLED display module is lighted up by an integrated circuit (IC) having the compensation algorithm so as to compensate for the image crosstalk.

In the embodiments of the present disclosure, the power-voltage variation value of the pixel unit is determined based on a variation value between the data voltage of the pixel unit at the current scanning time instant and the data voltage of the pixel unit at the previous scanning time instant, the compensated data voltage of the pixel unit is obtained based on the power-voltage variation value of the pixel unit, and the compensated data voltage of the pixel unit is taken as the actual data voltage to be applied to the pixel unit at the next scanning time instant. Since the data voltage applied to the pixel unit may be compensated in the embodiments of the present disclosure, the image crosstalk phenomenon resulted from signal couplings is alleviated.

Figure 3:
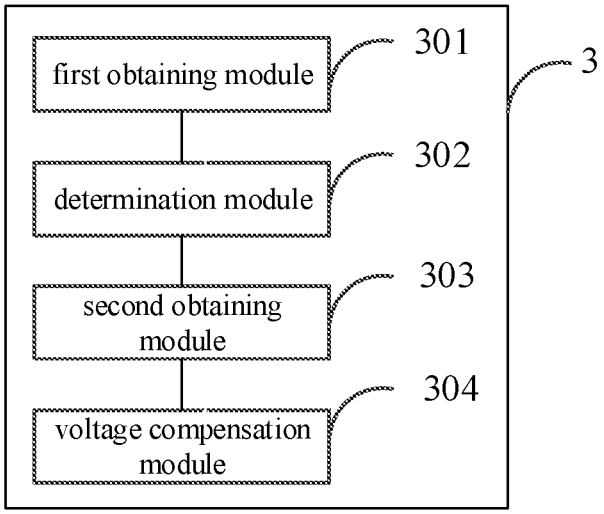
FIG. 3 is a schematic structural diagram of a device for compensating for image crosstalk according to some embodiments of the present disclosure.

FIG. 3 is a schematic structural diagram of a device for compensating for image crosstalk according to some embodiments of the present disclosure. As shown in FIG. 3, the device 3 for compensating for image crosstalk includes: a first obtaining module 301, configured to obtain a data-voltage variation value between a data voltage applied to a pixel unit at a current scanning time instant and a data voltage applied to the pixel unit at a previous scanning time instant; a determination module 302, configured to determine a power-voltage variation value of the pixel unit based on the data-voltage variation value; a second obtaining module 303, configured to set, as a compensated data voltage of the pixel unit, a sum of the power-voltage variation value of the pixel unit and an original data voltage to be applied to the pixel unit at a next time instant; and a voltage compensation module 304, configured to set the compensated data voltage of the pixel unit as an actual data voltage to be applied to the pixel unit at the next time instant.

Figure 4:
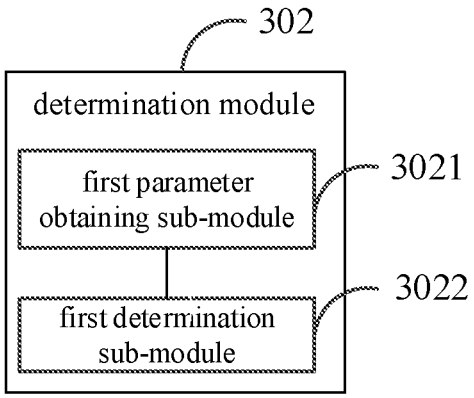
FIG. 4 is a schematic diagram of a determination module according to some embodiments of the present disclosure.

As shown in FIG. 4, the determination module 302 includes: a first parameter obtaining sub-module 3021, configured to obtain a coupling parameter of the pixel unit; and a first determination sub-module 3022, configured to set, as the power-voltage variation value, a product of the data-voltage variation value of the pixel unit and the coupling parameter of the pixel unit.

Specifically, the first parameter obtaining sub-module 3021 is configured to obtain the coupling parameter by testing a jump of the data voltage applied to the pixel unit.

Figure 5:
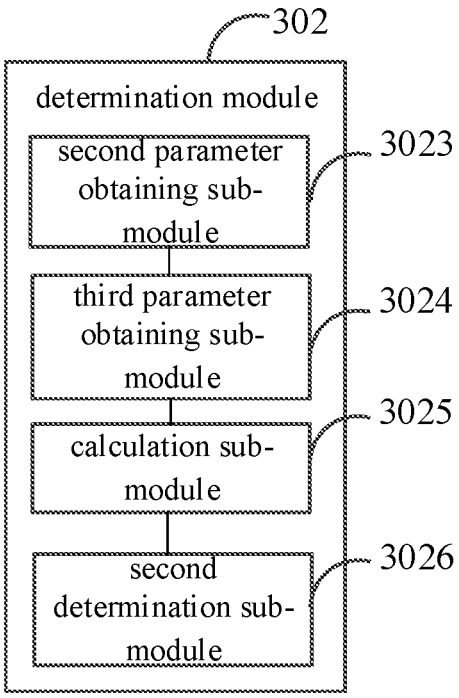
FIG. 5 is a schematic diagram of a determination module according to some embodiments of the present disclosure.
Figure 6:
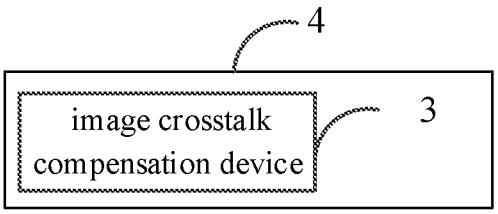
FIG. 6 is a schematic diagram of a display apparatus according to some embodiments of the present disclosure.

Optionally, as shown in FIG. 5, the determination module 302 may include: a second parameter obtaining sub-module 3023, configured to obtain the coupling parameter of the pixel unit; a third parameter obtaining sub-module 3024, configured to obtain data-voltage variation values between the current scanning time instant and the previous scanning time instant, coupling parameters and weight values of N adjacent pixel units adjacent to the pixel unit, respectively, where N is a positive integer; a calculation sub-module 3025, configured to calculate a product of the data-voltage variation value, the coupling parameter and the weight value of each adjacent pixel unit of the N adjacent pixel units so as to obtain a reference data-voltage variation value of the each adjacent pixel unit of the N adjacent pixel units; and a second determination sub-module 3026, configured to set, as the power-voltage variation value of the pixel unit, a sum of the reference data-voltage variation values of the N adjacent pixel units and a product of the coupling parameter and the data-voltage variation value of the pixel unit.

In practice, the second obtaining module 303 is specifically configured to set a sum of the power-voltage variation value and the original data voltage of the pixel unit as the compensated data voltage of the pixel unit.

An operational principle of the device for compensating for image crosstalk in the present disclosure may be obtained with reference to descriptions of the foregoing embodiments directed to the method.

In the present disclosure, the power-voltage variation value of the pixel unit is determined based on a variation value between the data voltage of the pixel unit at the current scanning time instant and the data voltage of the pixel unit at the previous scanning time instant, the compensated data voltage of the pixel unit is obtained based on the power-voltage variation value of the pixel unit, and the compensated data voltage of the pixel unit is taken as the actual data voltage to be applied to the pixel unit at the next scanning time instant. Since the data voltage applied to the pixel unit may be compensated in the present disclosure, the image crosstalk phenomenon resulted from signal couplings is alleviated.

The present disclosure further provides a display apparatus 4 including the device 3 for compensating for image crosstalk as shown in any one of FIG. 3 to FIG. 5.

Optional embodiments are described hereinabove. It should be noted that various improvements and embellishments may be made by the ordinary skilled in the art without departing from the principle of the present disclosure. The improvements and embellishments all fall within the protection scope of the present disclosure.

What is claimed is:

1. A method for compensating for image crosstalk, comprising:

obtaining a data-voltage variation value between a data voltage applied to a pixel unit at a current scanning time instant and a data voltage applied to the pixel unit at a previous scanning time instant;

determining a power-voltage variation value based on the data-voltage variation value;

based on the power-voltage variation value and an original data voltage to be applied to the pixel unit at a next time instant, obtaining a compensated data voltage of the pixel unit; and setting the compensated data voltage of the pixel unit as an actual data voltage to be applied to the pixel unit at the next time instant.

2. The method for compensating for image crosstalk according to claim 1, wherein the determining the power-voltage variation value based on the data-voltage variation value comprises:

obtaining a coupling parameter of the pixel unit; and setting a product of the data-voltage variation value of the pixel unit and the coupling parameter of the pixel unit as the power-voltage variation value.

3. The method for compensating for image crosstalk according to claim 2, wherein the obtaining the coupling parameter of the pixel unit comprises:

obtaining the coupling parameter by testing a jump of the data voltage applied to the pixel unit.

4. The method for compensating for image crosstalk according to claim 1, wherein the determining the power-voltage variation value based on the data-voltage variation value comprises:

obtaining a coupling parameter of the pixel unit;

obtaining data-voltage variation values between the current scanning time instant and the previous scanning time instant, coupling parameters and weight values of N adjacent pixel units adjacent to the pixel unit respectively, where N is a natural number;

calculating a product of the data-voltage variation value, the coupling parameter and the weight value of each adjacent pixel unit of the N adjacent pixel units so as to obtain a reference data-voltage variation value of the each adjacent pixel unit of the N adjacent pixel units; and setting, as the power-voltage variation value, a sum of the reference data-voltage variation values of the N adjacent pixel units and a product of the coupling parameter and the data-voltage variation value of the pixel unit.

5. The method for compensating for image crosstalk according to claim 1, wherein obtaining the compensated data voltage of the pixel unit based on the power-voltage variation value and the original data voltage to be applied to the pixel unit at the next time instant comprises:

setting the sum of the power-voltage variation value and the original data voltage to be applied to the pixel unit at the next time instant as the compensated data voltage of the pixel unit.

6. The method for compensating for image crosstalk according to claim 4, wherein the adjacent pixel units and the pixel unit are arranged in a same pixel row, and the adjacent pixel units are adjacent to the pixel unit.

7. A device for compensating for image crosstalk, comprising:

a first obtaining module, configured to obtain a data-voltage variation value between a data voltage applied to a pixel unit at a current scanning time instant and a data voltage applied to the pixel unit at a previous scanning time instant;

a determination module, configured to determine a power-voltage variation value of the pixel unit based on the data-voltage variation value;

a second obtaining module, configured to, based on the power-voltage variation value and an original data voltage to be applied to the pixel unit at a next time instant-$a_t$ obtain a compensated data voltage of the pixel unit; and a voltage compensation module, configured to set the compensated data voltage of the pixel unit as an actual data voltage to be applied to the pixel unit at a next time instant.

8. The device for compensating for image crosstalk according to claim 7, wherein the determination module comprises:

a first parameter obtaining sub-module, configured to obtain a coupling parameter of the pixel unit; and a first determination sub-module, configured to set a product of the data-voltage variation value of the pixel unit and the coupling parameter of the pixel unit as the power-voltage variation value.

9. The device for compensating for image crosstalk according to claim 8, wherein the first parameter obtaining sub-module is further configured to obtain the coupling parameter by testing a jump of the data voltage applied to the pixel unit.

10. The device for compensating for image crosstalk according to claim 7, wherein the determination module comprises:

a second parameter obtaining sub-module, configured to obtain a coupling parameter of the pixel unit;

a third parameter obtaining sub-module, configured to obtain data-voltage variation values between the current scanning time instant and the previous scanning time instant, coupling parameters and weight values of N adjacent pixel units adjacent to the pixel unit respectively, where N is a natural number;

a calculation sub-module, configured to calculate a product of the data-voltage variation value, the coupling parameter and the weight value of each adjacent pixel unit of the N adjacent pixel units so as to obtain a reference data-voltage variation value of the each adjacent pixel unit of the N adjacent pixel units; and a second determination sub-module, configured to set, as the power-voltage variation value, a sum of the reference data-voltage variation values of the N adjacent pixel units and a product of the coupling parameter and the data-voltage variation value of the pixel unit.

11. The device for compensating for image crosstalk according to claim 7, wherein the second obtaining module is further configured to set a sum of the power-voltage variation value and the original data voltage as the compensated data voltage.

12. The device for compensating for image crosstalk according to claim 10, wherein the adjacent pixel units and the pixel unit are arranged in a same pixel row, and the adjacent pixel units are adjacent to the pixel unit.

13. A display apparatus, comprising:

the device for compensating for image crosstalk according to claim 7.

* * * * *